US010028627B2

(12) United States Patent
Boeltl

(10) Patent No.: US 10,028,627 B2
(45) Date of Patent: Jul. 24, 2018

(54) LIGATURE RESISTANT ROLL HOLDER ASSEMBLY

(71) Applicant: Acorn Engineering Company, City of Industry, CA (US)

(72) Inventor: Darryl Boeltl, Whittier, CA (US)

(73) Assignee: Acorn Engineering Company, City of Industry, CA (US)

( * ) Notice: Subject to any disclaimer, the term of this patent is extended or adjusted under 35 U.S.C. 154(b) by 188 days.

(21) Appl. No.: 15/214,707

(22) Filed: Jul. 20, 2016

(65) Prior Publication Data

US 2018/0020886 A1 Jan. 25, 2018

(51) Int. Cl.

| | |
|---|---|
| ***A47K 10/40*** | (2006.01) |
| ***B65H 16/06*** | (2006.01) |
| *A47K 10/32* | (2006.01) |

(52) U.S. Cl.

CPC ..... *A47K 10/40* (2013.01); *B65H 16/06* (2013.01); *A47K 2010/3233* (2013.01)

(58) Field of Classification Search

CPC ..... A47K 10/38; A47K 10/40; A47K 2010/3233; B65H 16/06; B65H 75/18

See application file for complete search history.

(56) References Cited

U.S. PATENT DOCUMENTS 1,119,179 A * 12/1914 Krauth ..... B65H 16/06 242/596.4
1,523,491 A * 1/1925 Rast ..... A47K 10/38 242/596.4
2,819,852 A 1/1958 Silvio
2,905,404 A * 9/1959 Simmons ..... A47K 10/40 242/423.2
2,942,795 A 6/1960 McCreary
3,729,145 A 4/1973 Koo et al.
3,878,998 A * 4/1975 Lazzari ..... A47K 10/40 242/596.4
3,986,677 A * 10/1976 Ootaki ..... A47K 10/40 242/560.3
4,614,312 A * 9/1986 Del Pino ..... A47K 10/40 242/559
D362,773 S * 10/1995 Kartchner ..... D6/523
6,092,758 A * 7/2000 Gemmell ..... A47K 10/40 242/596.4
6,328,253 B1 12/2001 Paul
(Continued)

*Primary Examiner* — William A. Rivera
(74) *Attorney, Agent, or Firm* — Eric J. Sosenko; Jonathan P. O'Brien; Honigman Miller Schwartz and Cohn LLP

(57) ABSTRACT

An assembly is provided. The assembly is configured to be disposed within a wall having an outer surface and an aperture formed in the outer surface. The assembly includes a housing and a lateral support assembly. The housing includes a lateral wall and a medial wall. The lateral wall includes a lateral outer surface, a lateral inner surface, and a lateral aperture extending through the lateral outer surface and the lateral inner surface. The lateral support assembly includes a retainer, a support housing, a button, and a biasing member. The retainer is disposed within the lateral aperture. The support housing is coupled to the retainer. The button is at least partially disposed within the passage of the retainer and within the passage of the support housing. The biasing member is at least partially disposed within the passage of the retainer and within the passage of the support housing.

20 Claims, 6 Drawing Sheets

(56) References Cited

U.S. PATENT DOCUMENTS

| | | | | |
|---|---|---|---|---|
| 6,409,120 | B1 | 6/2002 | Tramontina et al. | |
| 6,607,160 | B2 | 8/2003 | Lewis et al. | |
| 6,848,349 | B2 | 2/2005 | Tramontina et al. | |
| 2003/0146339 | A1* | 8/2003 | Liu | B65H 16/005 242/596.4 |
| 2006/0163418 | A1* | 7/2006 | Ko | A47K 10/40 242/596.4 |
| 2007/0131818 | A1 | 6/2007 | Ko | |

* cited by examiner

LIGATURE RESISTANT ROLL HOLDER ASSEMBLY

FIELD

The present disclosure relates to a roll holder assembly and more particularly to a ligature resistant roll holder assembly.

BACKGROUND

This section provides background information related to the present disclosure and is not necessarily prior art.

Roll holder assemblies are used to secure various types of rolled products, including paper products such as toilet paper and paper towels, for example. A roll holder assembly may include a base and one or more support members. The support members are often coupled to the base and used to secure the rolled product relative to the base. While conventional roll holder assemblies may have proven useful for their intended purposes, a continuous need for improvement in the relevant art remains.

DRAWINGS

The drawings described herein are for illustrative purposes only of selected configurations and are not intended to limit the scope of the present disclosure.

Corresponding reference numerals indicate corresponding parts throughout the drawings.

SUMMARY

Figure 1:
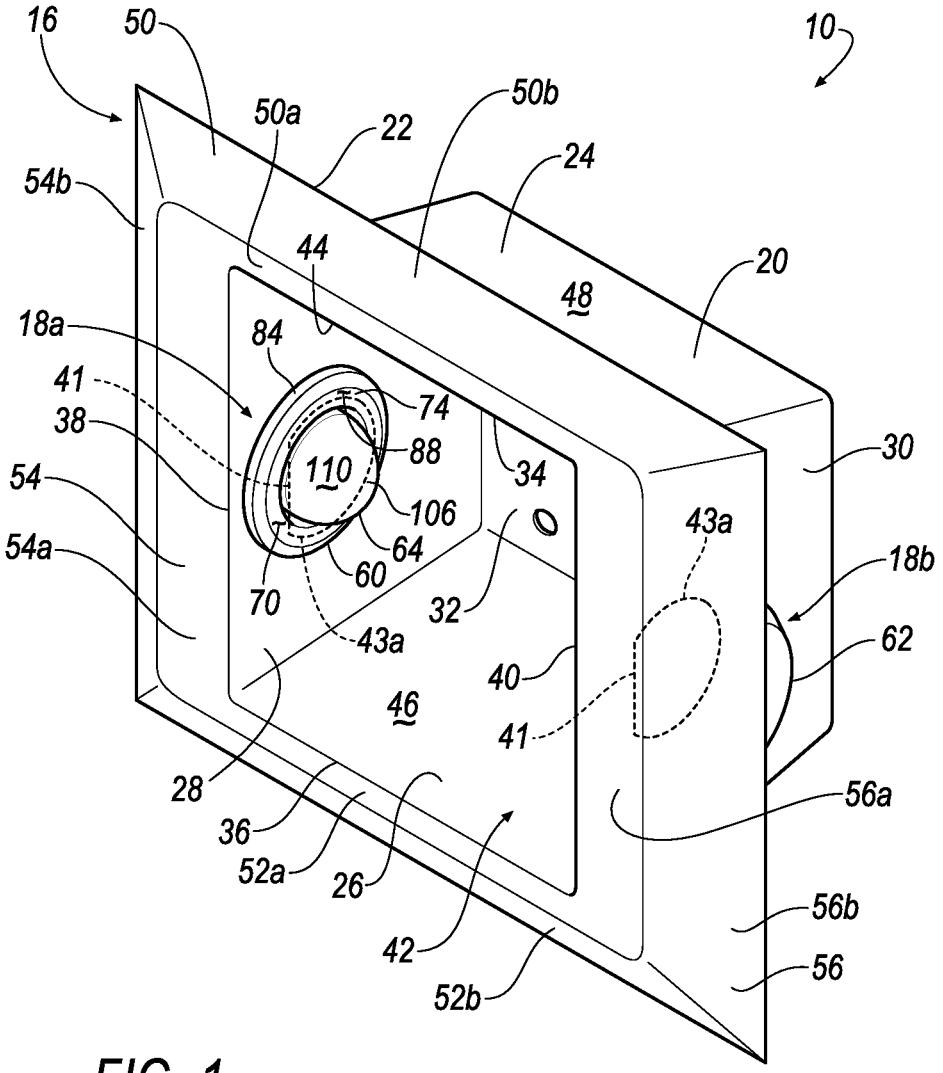
FIG. 1 is a perspective view of a ligature resistant roll holder assembly in accordance with the principles of the present disclosure.

This section provides a general summary of the disclosure, and is not a comprehensive disclosure of its full scope or all of its features.

In some aspects of the present disclosure, a ligature resistant roll holder assembly is provided. The assembly may be configured to be disposed within a wall having an outer surface and an aperture formed in the outer surface. The assembly may include a housing and a lateral support assembly. The housing may include a lateral wall and a medial wall opposite the lateral wall. The lateral wall may include a lateral outer surface, a lateral inner surface, and a lateral aperture extending through the lateral outer surface and the lateral inner surface. The lateral support assembly may be supported by the housing and may include a retainer, a support housing, a button, and a biasing member. The retainer may be disposed within the lateral aperture and may include a proximal end, an outer surface, an inner surface, and a flange. The inner surface may define a passage extending though the retainer. The flange may extend radially outwardly from the outer surface and may engage the lateral inner surface of the lateral wall. The support housing may be coupled to the retainer and may include a proximal end, a distal end, and an inner surface. The distal end of the support housing may engage the lateral outer surface of the lateral wall. The inner surface of the support housing may define a passage. The button may be at least partially disposed within the passage of the retainer and within the passage of the support housing. The button may include a radially-extending flange operable to engage the proximal end of the retainer. The biasing member may be at least partially disposed within the passage of the retainer and within the passage of the support housing. The biasing member may include a proximal end and a distal end. The proximal end of the biasing member may engage the support housing. The distal end of the biasing member may engage the button.

In some implementations, the housing includes a rim supported by at least one of the lateral wall and the medial wall. The rim may include a proximal portion and a distal portion. The proximal portion may extend transversely from the at least one of the lateral wall and the medial wall. The distal portion may extend transversely from proximal portion.

In some implementations, the housing is disposed within the aperture of the wall. The distal portion of the rim may engage the outer surface of the wall.

In some implementations, the proximal end of the support housing includes a hub disposed within the proximal end of the biasing member.

In some implementations, the proximal end of the button includes a hub disposed within the distal end of the biasing member. The button may include an actuation portion and a skirt portion extending from the actuation portion. The skirt portion may surround the hub. The radially-extending flange may extend radially outwardly from the skirt portion. The skirt portion may include an inner surface and an outer surface. The inner surface may define a passage. The hub may be disposed within the passage of the skirt portion. In some implementations, the outer surface includes a frustoconical shape.

In some implementations, the outer surface of the retainer includes a first threaded portion, and the inner surface of the support housing includes a second threaded portion coupled to the first threaded portion.

In other aspects of the present disclosure, a ligature resistant roll holder assembly is provided. The ligature resistant roll holder assembly may include a housing, a retainer, a support housing, a button, and a biasing member. The housing may include an outer surface, an inner surface, and an aperture extending through the outer surface and the inner surface. The retainer may be disposed within the aperture and may include a proximal end, a distal end, and an inner surface defining a passage extending from the proximal end to the distal end. The passage may include a first diameter. The support housing may be coupled to the retainer and may include a proximal end, a distal end, and a passage formed in the distal end of the support housing. The button may be at least partially disposed within the passage of the retainer and within the passage of the support housing. The button may include an actuation portion and a skirt portion extending from the actuation portion. The skirt portion may include a frustoconical outer surface having a second diameter and a third diameter. The second diameter may be less than the first diameter. The third diameter may be less than the second diameter. The biasing member may be at least partially disposed within the passage of the retainer and within the passage of the support housing. The biasing member may include a proximal end and a distal end. The proximal end may engage the support housing. The distal end may engage the button.

In some implementations, the frustoconical outer surface and the inner surface of the retainer collectively define an annular void. The button may be operable to angulate within the annular void.

In some implementations, the housing includes a base, a proximal rim portion coupled to the base, and a distal rim portion coupled to the proximal rim portion. The proximal rim portion may extend transversely from the base. The distal rim portion may extend transversely from the proximal rim portion.

In some implementations, the retainer includes an outer surface and a flange. The flange may extend radially outwardly from the outer surface of the retainer and may engage the inner surface of the housing. The distal end of the support housing may engage the outer surface of the housing.

In some implementations, the proximal end of the support housing includes a hub disposed within the proximal end of the biasing member.

In some implementations, the retainer includes a first threaded portion and the support housing includes a second threaded portion coupled to the first threaded portion.

In some implementations, the actuation portion includes a hub disposed within the distal end of the biasing member. The skirt portion may include an inner surface defining a passage. The hub may be disposed within the passage of the skirt portion The details of one or more implementations of the disclosure are set forth in the accompanying drawings and the description below. Other aspects, features, and advantages will be apparent from the description and drawings, and from the claims.

DETAILED DESCRIPTION

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

Figure 4A:
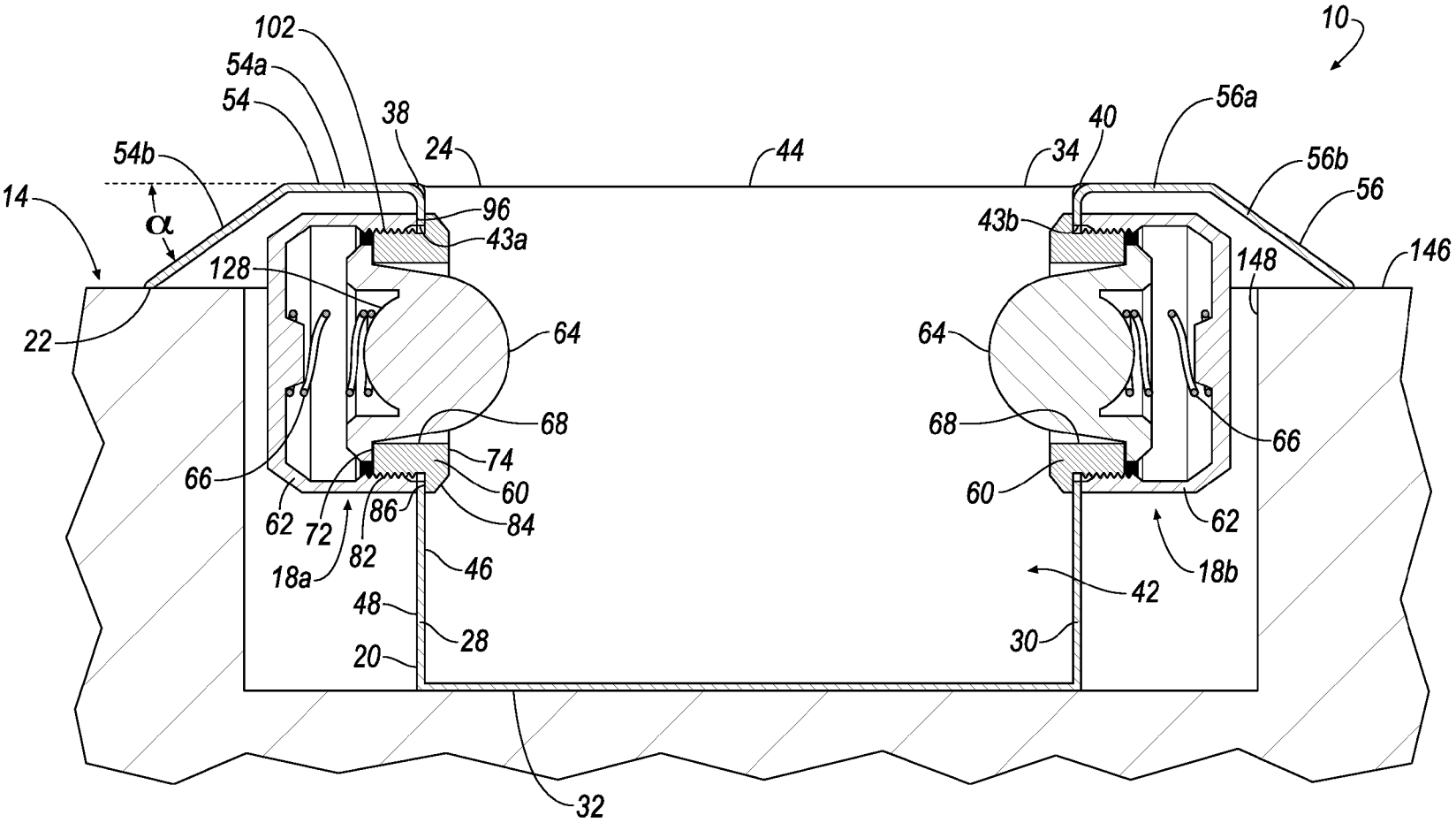
FIG. 4A is a cross-sectional view of the ligature resistant roll holder assembly of FIG. 1 separated from a rolled product.
Figure 4B:
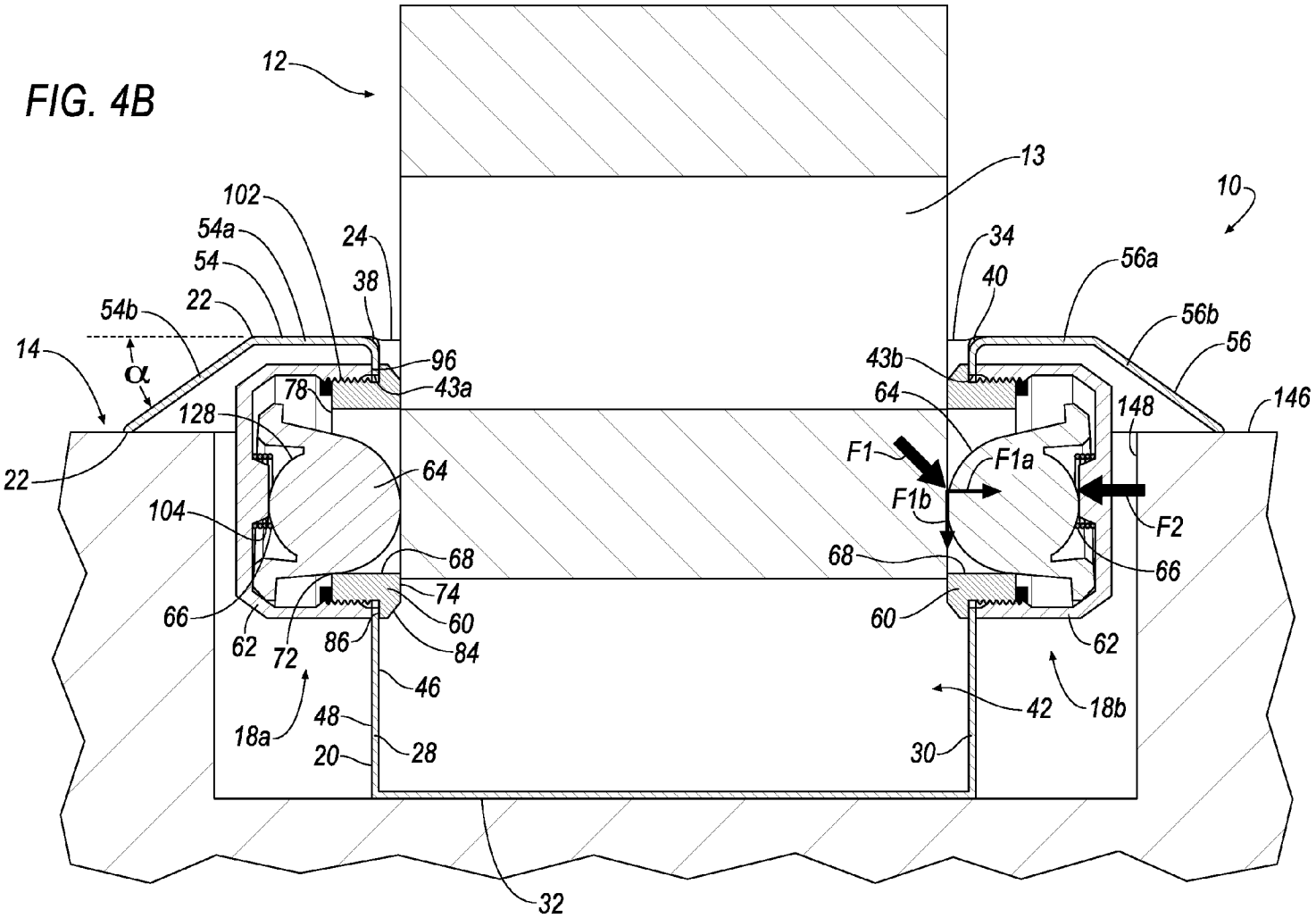
FIG. 4B is a cross-sectional view of the ligature resistant roll holder assembly of FIG. 1 partially assembled with a rolled product and disposed within a wall.
Figure 4C:
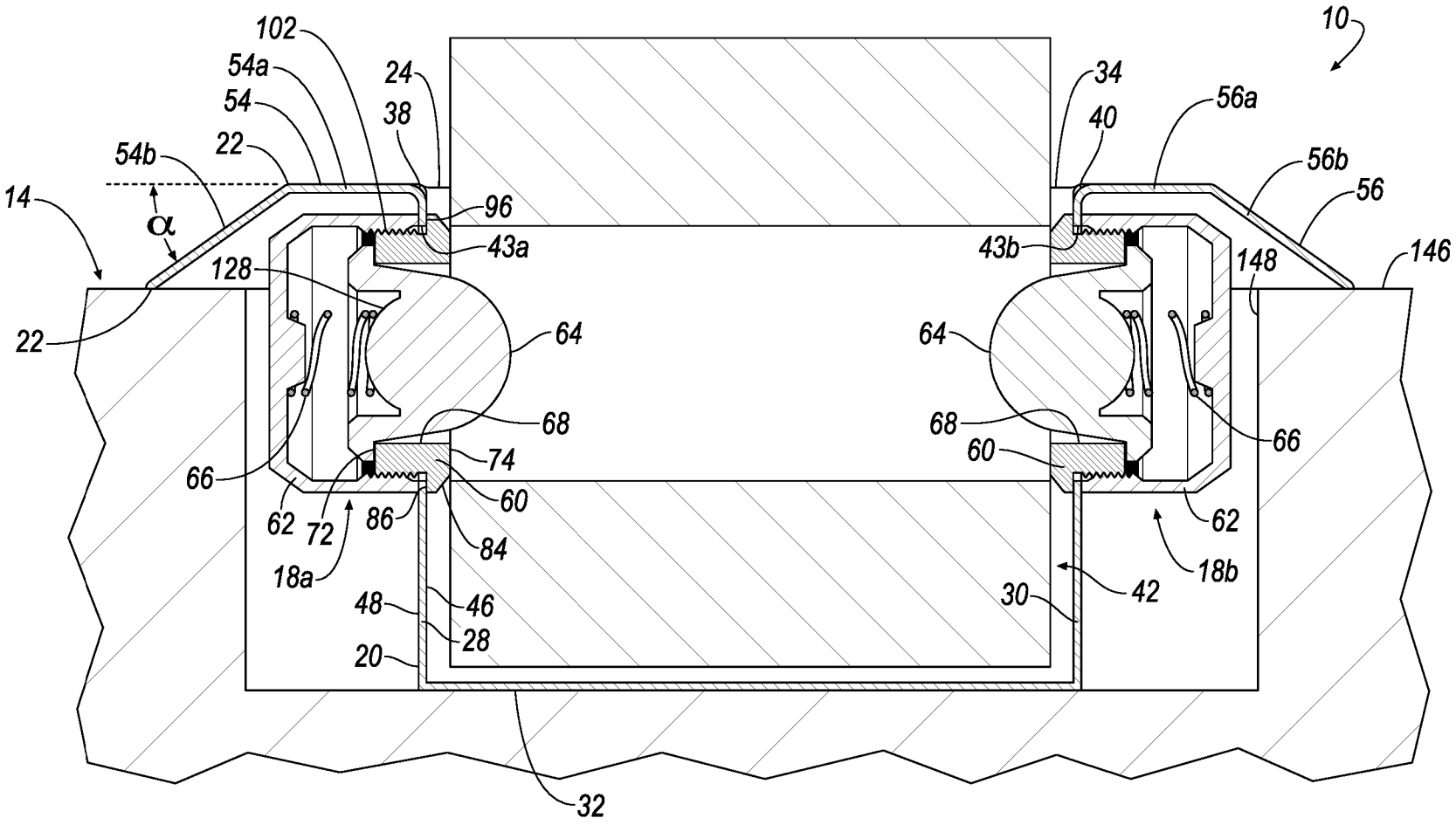
FIG. 4C is a cross-sectional view of the ligature resistant roll holder assembly of FIG. 1 fully assembled with a rolled product and disposed within a wall.

With reference to FIG. 1, a ligature resistant roll holder assembly 10 is provided. As illustrated in FIGS. 4A-4C, the assembly 10 may be configured for use with a rolled product 12 such as rolled paper products (e.g., paper towels, toilet paper, crate paper, etc.), rolled fabric products (e.g., cloth), and rolled metal products (e.g., aluminum, steel, copper, etc.) having a hollow core 13. As will be explained in more detail below, in use, the assembly 10 may be disposed in, and/or supported by, a wall 14 or other suitable structure.

The assembly 10 may include a housing 16, a lateral support assembly 18*a*, and a medial support assembly 18*b*. The housing 16 may include a base 20 and a rim 22. In some implementations, the base 20 may be integrally and/or monolithically formed with the rim 22, such that the housing 16 is a unitary construct.

Figure 2:
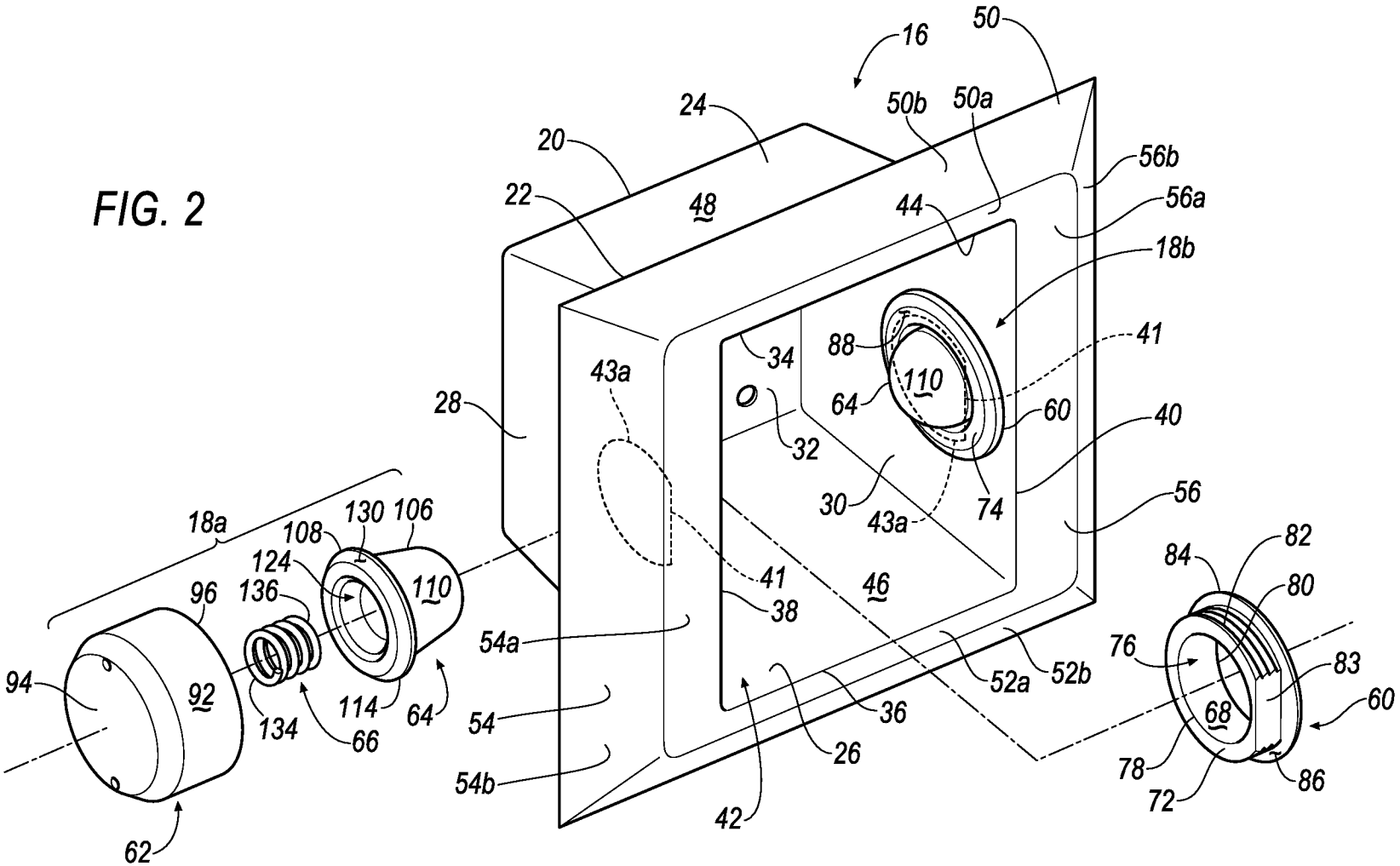
FIG. 2 is an exploded view of the ligature resistant roll holder assembly of FIG. 1.

With reference to FIGS. 1 and 2, the base 20 may include an upper wall 24, a lower wall 26, a lateral wall 28, a medial wall 30, and a rear wall 32. The upper wall 24 and the lower wall 26 may each extend from the lateral wall 28 to the medial wall 30. In this regard, the upper wall 24 may be substantially parallel (+/−15 degrees) to the lower wall 26, and the lateral wall 28 may be substantially parallel (+/−15 degrees) to the medial wall 30. The upper wall 24, the lower wall 26, the lateral wall 28, and the medial wall 30 may be substantially perpendicular (+/−15 degrees) to, and extend from, the rear wall 32. In this regard, the upper wall 24 may include an upper distal end 34, the lower wall 26 may include a lower distal end 36, the lateral wall 28 may include a lateral distal end 38, and the medial wall 30 may include a medial distal end 40.

In some implementations, the upper wall 24, the lower wall 26, the lateral wall 28, the medial wall 30, and the rear wall 32 may define a portion of a cuboid construct. In this regard, the upper wall 24, the lower wall 26, the lateral wall 28, the medial wall 30, and the rear wall 32 may define, and/or otherwise surround, a chamber 42 of the base 20. As illustrated in FIGS. 4A-4C, the lateral wall 28 may include a lateral aperture 43*a* in communication with the chamber 42, and the medial wall 30 may include a medial aperture 43*b* in communication with the chamber 42. The medial aperture 43*b* may be opposite, and aligned with, the lateral aperture 43*a*. In some implementations, the medial and lateral apertures 43*a* and 43*b* may each be substantially D-shaped, such that each aperture 43*a*, 43*b* is defined in part by a flat (e.g., linearly-extending) portion 41 of the housing 16. The upper distal end 34, the lower distal end 36, the lateral distal end 38, and the medial distal end 40 may collectively define an opening 44 in communication with the chamber 42. The opening 44 may be generally opposite the rear wall 32.

One or more of the upper wall 24, the lower wall 26, the lateral wall 28, the medial wall 30, and the rear wall 32 may collectively define an inner surface 46 and an outer surface 48 of the base 20. The inner surface 46 may be opposite the outer surface 48. In this regard, the inner surface 46 may surround the chamber 42.

With reference to FIGS. 1 and 2, the rim 22 may include an upper wall 50, a lower wall 52, a lateral wall 54, and a medial wall 56. The upper wall 50 and the lower wall 52 may each extend from the lateral wall 54 to the medial wall 56. The upper wall 50, the lower wall 52, the lateral wall 54, and the medial wall 56 may extend from the upper wall 24, the lower wall 26, the lateral wall 28, and the medial wall 30, respectively, of the base 20. For example, (i) the upper wall 50 may include a proximal portion 50*a* extending from the upper wall 24, and a distal portion 50*b* extending from the proximal portion 50*a*, (ii) the lower wall 52 may include a proximal portion 52*a* extending from the lower wall 26, and a distal portion (not shown) extending from the proximal portion 52*a*, (iii) the lateral wall 54 may include a proximal portion 54*a* extending from the lateral wall 28, and a distal portion 54*b* extending from the proximal portion 54*b*, and (iv) the medial wall 56 may include a proximal portion 56*a* extending from the medial wall 30, and a distal portion 56*b* extending from the proximal portion 56*a*.

The proximal portions 50*a*, 52*a*, 54*a*, 56*a* of the upper wall 50, lower wall 52, lateral wall 54, and medial wall 56, respectively, may be substantially perpendicular (+/−15 degrees) to the upper wall 24, the lower wall 26, the lateral wall 28, and the medial wall 30, respectively, of the base 20. The distal portions 50*b*, 52*b*, 54*b*, 56*b* of the upper wall 50, lower wall 52, lateral wall 54, and medial wall 56, respectively, may each define an angle $\alpha$ (e.g., FIGS. 4A-4C) with the proximal portions 50*a*, 52*a*, 54*a*, 56*a*, respectively. The angle $\alpha$ may be between zero degrees and ninety degrees. In some implementations, the angle $\alpha$ may be substantially equal to forty-five degrees. In this regard, as illustrated in FIGS. 4A-4C, the angle $\alpha$ may be such that the rim 22, including the upper wall 24, the lower wall 26, the lateral wall 28, and the medial wall 30, defines a ligature-resistant portion of the housing 16 when the housing 16 is disposed within the wall 14. In particular, the rim 22 may define a low profile relative to the wall 14 when the housing 16 is disposed within the wall 14.

The lateral support assembly 18*a* and the medial support assembly 18*b* may be coupled to the housing 16. For example, as illustrated in FIGS. 4A-4C, the lateral support assembly 18*a* may be coupled to the lateral wall 28 of the base 20, and the medial support assembly 18*b* may be coupled to the medial wall 30 of the base 20. In this regard, as will be explained in more detail below, in the assembled configuration the lateral support assembly 18*a* may be disposed within the lateral aperture 43*a*, and the medial support assembly 18*b* may be disposed within the medial aperture 43*b*.

The lateral support assembly 18*a* may be substantially identical to, and aligned with, the medial support assembly 18*b*. Accordingly, references herein to the support assembly 18 will be understood to apply equally to the lateral support assembly 18*a* and the medial support assembly 18*b*, except as otherwise provided herein.

The support assembly 18 may include a retainer 60, a housing 62, a button 64, and a biasing member 66. The retainer 60 may include an inner surface 68, an outer surface 70, a proximal end 72, and a distal end 74. As illustrated in FIG. 2, the inner surface 68 may define a passage 76 extending through the retainer 60 from the proximal end 72 to the distal end 74, such that the proximal end 72 includes an entrance opening 78, and the distal end 74 includes an exit opening 80. In some implementations, the inner surface 68 may include a substantially cylindrical shape, and the entrance opening 78 and exit opening 80 may include a substantially circular shape such that the passage 76 defines a substantially cylindrical shape having a diameter D1.

Figure 3:
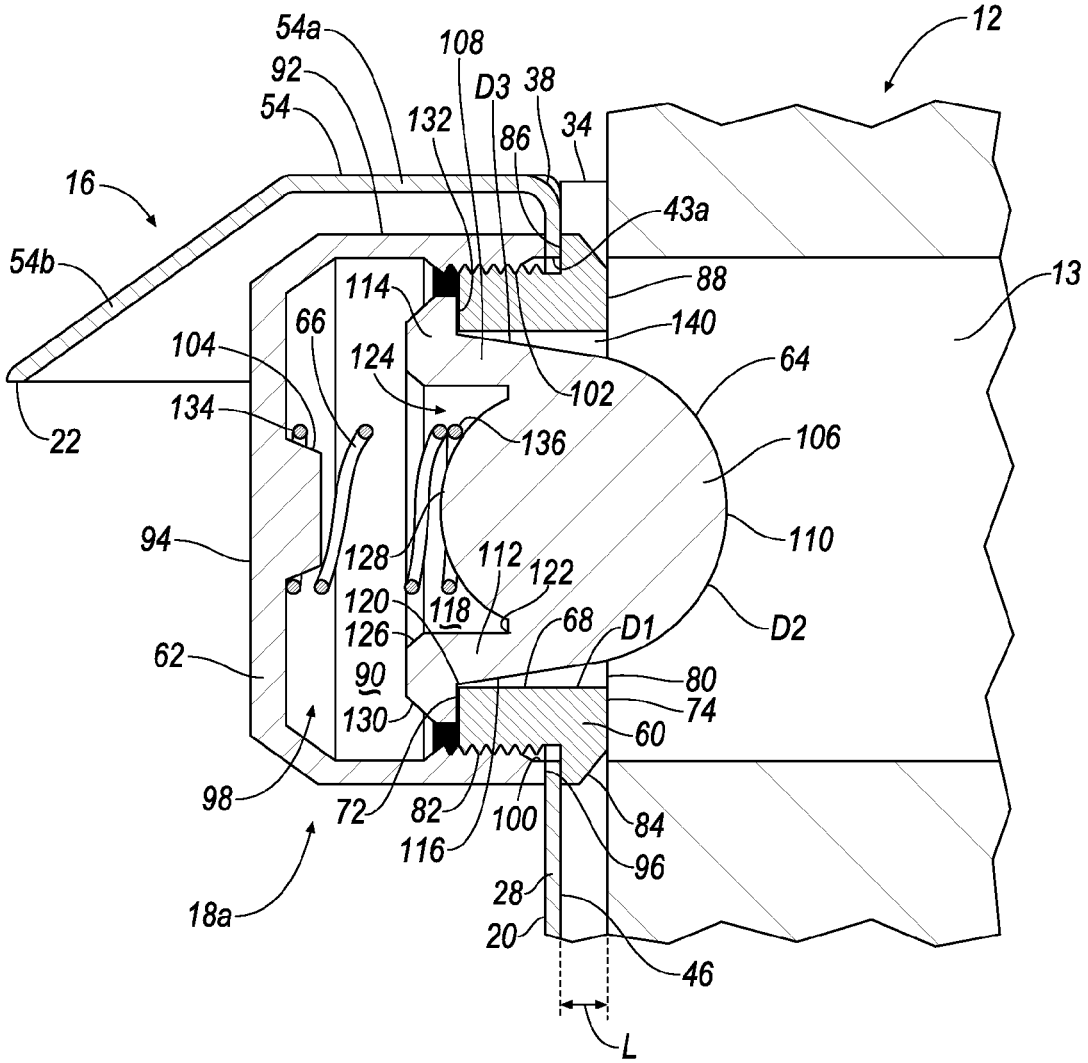
FIG. 3 is a cross-sectional view of a button subassembly of the ligature resistant roll holder assembly of FIG. 1.

The outer surface 70 of the retainer 60 may include a retaining portion 82 and a flange 84. The retaining portion 82 may extend annularly about the outer surface 70 from the proximal end 72 of the retainer 60. In some implementations, the retaining portion 82 may be threaded and include a flat 83, such that the retaining portion 82 defines a substantially D-shaped construct. The flange 84 may extend annularly about the outer surface 70 from the distal end 74 of the retainer 60. In this regard, the flange 84 may include a proximal surface 86 and a distal surface 88. In some implementations, the proximal and distal surfaces 86, 88 may extend radially outward from the outer surface 70 of the retainer 60. For example, as illustrated in FIG. 3, the proximal surface 86 may be generally opposite the distal surface 88 such that the proximal and distal surfaces 86, 88 define an axially extending distance L extending therebetween. The distance L may be between 1 millimeter and 20 millimeters in order to prevent the retainer 60 from defining a ligature proximate the inner surface 46 of the base 20, or otherwise define a ligature resistant retainer 60. In some implementations, the distance L may be substantially equal to 5 millimeters. In some configurations, the distal surface 88 may include a convex shape or profile extending contiguously from and with the distal end 74 of the retainer 60.

With reference to FIGS. 2 and 3, the housing 62 may include an inner surface 90, an outer surface 92, a proximal end 94, and a distal end 96. The inner surface 90 may define a chamber or passage 98 extending through the distal end 96 of the housing 62, such that the distal end 96 includes an opening 100. In some implementations, the inner surface 90 may include a substantially cylindrical shape, and the opening 100 may include a substantially circular shape such that the passage 98 defines a substantially cylindrical shape.

The inner surface 90 of the housing 62 may include a threaded portion 102 extending annularly about the inner surface 90 from the distal end 96. The proximal end 94 of the housing 62 may include an axially-extending hub 104 disposed within the passage 98.

The button 64 may include an actuation portion 106 and a base portion 108. The actuation portion 106 may include an outer surface 110. The outer surface 110 may include a convex shape or profile. In some implementations, the outer surface 110 may define a generally spherical shape or construct having a diameter D2.

The base portion 108 may be integrally and/or monolithically formed with the actuation portion 106 and may include a skirt 112 and a flange 114. The skirt 112 may include an outer surface 116, an inner surface 118, a proximal end 120, and a distal end 122. The distal end 122 may be coupled to, or otherwise integrally formed with, the actuation portion 106, such that the outer surface 116 extends contiguously from and with the outer surface 110 of the actuation portion 106. In some implementations, the outer surface 116 may extend tangentially from the outer surface 110 of the actuation portion 106. In this regard, the outer surface 116 may include a substantially frustoconical shape or construct defining a diameter D3. The diameter D3 may vary in an axially extending direction such that the diameter D3 includes a minimum value proximate the actuation portion 106 and a maximum value proximate the flange 114. As such, the diameter D3 provides the outer surface 116 with a substantially constant taper extending from the actuation portion 106 to the flange 114. The minimum value of the diameter D3 may be less than the diameter D1 of the passage 76. The maximum value of the diameter D3 may be substantially equal to the diameter D1 of the passage 76. As will be explained in more detail below, the diameter D3 (e.g., the minimum value of the diameter D3) and the diameter D1 of the passage 76 may allow the button 64 to tilt and/or otherwise move in a radially-extending direction in an assembled configuration.

The inner surface 118 of the skirt 112 may define a chamber or passage 124 extending through the proximal end 120 of the skirt 122, such that the proximal end 120 includes an opening 126. In some implementations, the inner surface 118 may include a substantially cylindrical shape, and the opening 126 may include a substantially circular shape, such that the passage 124 defines a substantially cylindrical shape. As illustrated in FIG. 3, the button 64 may further include an axially-extending hub 128 disposed within the passage 124. In this regard, the outer surface 110 of the actuation portion 106 may define the axially-extending hub 128.

The flange 114 may extend annularly about the outer surface 116 of the skirt 112 proximate the proximal end 120. In this regard, the flange 114 may include a proximal surface 130 and a distal surface 132. In some implementations, the proximal and distal surfaces 130, 132 may extend radially outward from the outer surface 116 of the skirt 112. For example, the proximal surface 130 may be generally opposite the distal surface 132. In some configurations, the proximal surface 130 may extend contiguously from and with the proximal end 120 of the skirt 112.

The biasing member 66 may include a proximal end 134 and a distal end 136. While the biasing member 66 is generally illustrated and described herein as including a helical compression spring, it will be appreciated that the biasing member 66 may include any type of biasing member known in the art. For example, the biasing member 66 may include a spring (e.g., a compression spring, a torsion spring, a leaf spring, etc.) or a resilient material (e.g., a polymeric material) within the scope of the present disclosure.

With reference to at least FIGS. 3 and 4A-4C, in an assembled configuration, the retainer 60 of the lateral support assembly 18*a* may be disposed within the lateral aperture 43*a* of the lateral wall 28, and the medial support assembly 18*b* may be disposed within the medial aperture 43*b* of the medial wall 30 such that the proximal surface 86 of the flange 84 engages the inner surface 46 of the base 20. In this regard, aligning the flat portion 41 of the apertures 43*a*, 43*b* with the flat 83 of the retainer 60 may (i) allow a user to assemble the retainer 60 relative to the housing 16, and (ii) prevent the user from rotating the retainer 60 relative to, and/or removing the retainer 60 from, the housing 16. The housing 62 may be threadably coupled to the retainer 60. In particular, the threaded portion 102 of the housing 62 may be threadably-coupled to the retaining portion 82 of the retainer 60 such that the distal end 96 of the housing 62 engages the outer surface 48 of the base 20. Accordingly, once the retainer is threadably-coupled to the housing 62, the flat portion 41 of the apertures 43*a*, 43*b* and the flat 83 of the retainer 60 may prevent the user from rotating the retainer 60, and thus prevent the user from removing the retainer 60 from the housing 16. The button 64 may be translatably disposed within the passage 76 of the retainer 60 and within the passage 98 of the housing 62. In this regard, the actuation portion 106 of the button 64 may extend through the exit opening 80 of the retainer 60, and the base portion 108 of the button 64 may extend through the entrance opening 78 of the retainer 60.

The button 64 may be translatable in a first direction between a first or locked position (e.g., FIGS. 4A and 4C) and a second or unlocked position (e.g., FIG. 4B). As illustrated in FIG. 3, in the locked position, the distal surface 132 of the flange 114 may engage the proximal end 72 of the retainer 60. In the locked and/or unlocked positions, the button 64 may further be operable to angulate in a plurality of directions transverse to the first direction. In this regard, in the assembled configuration, the diameter D2 of the actuation portion 106, the diameter D3 (e.g., the minimum value of the diameter D3) of the skirt 112, and/or the diameter D1 of the passage 76, may define an annular void 140 allowing the button 64 to angulate relative to the first direction and/or otherwise move in a radially-extending direction.

The biasing member 66 may be disposed within the passage 98 of the housing 62 and within the passage 124 of the button 64. In this regard, as illustrated in FIGS. 4A-4C, the hub 104 of the housing 62 may be disposed within the proximal end 134 of the biasing member 66, and the hub 128 of the button 64 may be disposed within the distal end 136 of the biasing member 66. Accordingly, the biasing member 66 may be operable to cause the button 64 to translate within the passage 76 of the retainer 60 and the passage 98 of the housing 62 from and between the locked position and the unlocked position.

The housing 16 may be disposed within the wall 14 such that the distal portions 50*b*, 52*b*, 54*b*, 56*b* of the upper wall 50, lower wall 52, lateral wall 54, and medial wall 56, respectively, engage the wall 14. In this regard, as illustrated in FIGS. 4A-4C, the wall 14 may include an outer surface 146 and an aperture 148 formed in the outer surface 146. The upper, lower, lateral, medial, and rear walls 24, 26, 28, 30, 32 may be disposed within the aperture 148 such that the rim 22 engages the outer surface 146. For example, the distal portions 50*b*, 52*b*, 54*b*, 56*b* of the upper wall 50, lower wall 52, lateral wall 54, and medial wall 56, respectively, may engage the outer surface 146 of the wall 14.

A method of using the ligature resistant roll holder assembly 10 may include translating the rolled product 12 in a second direction transverse to the first direction. For example, as illustrated in FIGS. 4A and 4B, a user may translate the rolled product 12 in a direction substantially orthogonal to the first direction until the rolled product 12 engages the button 64. Upon engaging the button 64, the rolled product 12 may apply a force F1 on the button 64. The force F1 may include an axial component F1*a* and a radial component F1*b*. The axial component F1*a* may oppose a biasing force F2 of the biasing member 66 and cause the button 64 to translate in the first direction. The radial component F1*b* may cause the button 64 to angulate relative to the first direction in order to change the size and/or shape of the annular void 140. The user may continue to apply the force F1 on the rolled product 12 until the button 64 is aligned with the core 13 of the rolled product 12. Upon aligning the button 64 with the core 13 of the rolled product 12, the force F2 of the biasing member 66 may cause the button 64 to translate in a third direction, opposite the first direction, until the button 64 is disposed within the core 13.

In the assembled configuration (e.g., FIGS. 4A-4C), the configuration of the rim 22 relative to the wall 14 and/or the configuration of the retainer 60 relative to the housing 16 helps to ensure that the assembly 10 is ligature-resistant.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. An assembly configured to be disposed within a wall having an outer surface and an aperture formed in the outer surface, the assembly comprising:

a housing including a lateral wall and a medial wall opposite the lateral wall, the lateral wall including a lateral outer surface, a lateral inner surface, and a lateral aperture extending through the lateral outer surface and the lateral inner surface;

a lateral support assembly supported by the housing, the lateral support assembly including:

a retainer disposed within the lateral aperture and including a proximal end, an outer surface, an inner surface, and a flange, the inner surface defining a passage extending through the retainer, the flange extending radially outwardly from the outer surface of the retainer and engaging the lateral inner surface of the lateral wall;

a support housing coupled to the retainer, the support housing including a proximal end, a distal end, and an inner surface, the distal end of the support housing engaging the lateral outer surface of the lateral wall, the inner surface of the support housing defining a passage;

a button at least partially disposed within the passage of the retainer and within the passage of the support housing, the button including a radially-extending flange operable to engage the proximal end of the retainer; and a biasing member at least partially disposed within the passage of the retainer and within the passage of the support housing, the biasing member having a proximal end and a distal end, the proximal end of the biasing member engaging the support housing, the distal end of the biasing member engaging the button.

2. The assembly of claim 1, wherein the housing includes a rim supported by at least one of the lateral wall and the medial wall, the rim including a proximal portion and a distal portion, the proximal portion extending transversely from the at least one of the lateral wall and the medial wall, the distal portion extending transversely from proximal portion.

3. The assembly of claim 2, wherein the housing is disposed within the aperture of the wall.

4. The assembly of claim 3, wherein the distal portion of the rim engages the outer surface of the wall.

5. The assembly of claim 1, wherein the proximal end of the support housing includes a hub disposed within the proximal end of the biasing member.

6. The assembly of claim 1, wherein the proximal end of the button includes a hub disposed within the distal end of the biasing member.

7. The assembly of claim 6, wherein the button includes an actuation portion and a skirt portion extending from the actuation portion, the skirt portion surrounding the hub, the radially-extending flange extending radially outwardly from the skirt portion.

8. The assembly of claim 7, wherein the skirt portion includes an inner surface and an outer surface, the inner surface of the skirt portion defining a passage, the hub disposed within the passage of the skirt portion.

9. The assembly of claim 8, wherein the outer surface of the skirt portion includes a frustoconical shape.

10. The assembly of claim 1, wherein the outer surface of the retainer includes a first threaded portion, and the inner surface of the support housing includes a second threaded portion coupled to the first threaded portion.

11. An assembly comprising:

a housing having an outer surface, an inner surface, and an aperture extending through the outer surface and the inner surface; and a retainer disposed within the aperture and including a proximal end, a distal end, and an inner surface defining a passage extending from the proximal end to the distal end, the passage having a first diameter;

a support housing coupled to the retainer, the support housing including a proximal end, a distal end, and a passage formed in the distal end of the support housing;

a button at least partially disposed within the passage of the retainer and within the passage of the support housing, the button including an actuation portion and a skirt portion extending from the actuation portion, the skirt portion including a frustoconical outer surface having a second diameter and a third diameter, the second diameter less than the first diameter, the third diameter less than the second diameter; and a biasing member at least partially disposed within the passage of the retainer and within the passage of the support housing, the biasing member having a proximal end and a distal end, the proximal end engaging the support housing, the distal end engaging the button.

12. The assembly of claim 11, wherein the frustoconical outer surface and the inner surface of the retainer collectively define an annular void.

13. The assembly of claim 12, wherein the button is operable to angulate within the annular void.

14. The assembly of claim 11, wherein the housing includes a base, a proximal rim portion coupled to the base, and a distal rim portion coupled to the proximal rim portion, the proximal rim portion extending transversely from the base, the distal rim portion extending transversely from the proximal rim portion.

15. The assembly of claim 11, wherein the retainer includes an outer surface and a flange, the flange extending radially outwardly from the outer surface of the retainer and engaging the inner surface of the housing.

16. The assembly of claim 15, wherein the distal end of the support housing engages the outer surface of the housing.

17. The assembly of claim 11, wherein the proximal end of the support housing includes a hub disposed within the proximal end of the biasing member.

18. The assembly of claim 11, wherein the retainer includes a first threaded portion and the support housing includes a second threaded portion coupled to the first threaded portion.

19. The assembly of claim 11, wherein the actuation portion includes a hub disposed within the distal end of the biasing member.

20. The assembly of claim 19, wherein the skirt portion includes an inner surface defining a passage, the hub disposed within the passage of the skirt portion.

* * * * *